US008016545B2

(12) United States Patent
Oklejas, Jr.

(10) Patent No.: US 8,016,545 B2
(45) Date of Patent: Sep. 13, 2011

(54) THRUST BALANCING IN A CENTRIFUGAL PUMP

(75) Inventor: Eli Oklejas, Jr., Monroe, MI (US)

(73) Assignee: Fluid Equipment Development Company, LLC, Monroe, MI (US)

( * ) Notice: Subject to any disclaimer, the term of this patent is extended or adjusted under 35 U.S.C. 154(b) by 1128 days.

(21) Appl. No.: 11/811,621

(22) Filed: Jun. 11, 2007

(65) Prior Publication Data

US 2007/0292283 A1 Dec. 20, 2007

Related U.S. Application Data

(60) Provisional application No. 60/813,763, filed on Jun. 14, 2006.

(51) Int. Cl.
*F01D 3/00* (2006.01)

(52) U.S. Cl. ..... 415/106; 415/111; 415/112

(58) Field of Classification Search ..... 415/104, 415/105, 110, 111, 112, 113, 106
See application file for complete search history.

(56) References Cited

U.S. PATENT DOCUMENTS

| | | | |
|---|---|---|---|
| 659,930 | A | 10/1900 | Kemble |
| 893,127 | A | 7/1908 | Barber |
| 1,022,683 | A | 4/1912 | Kienast |
| 1,024,111 | A | 4/1912 | Anderson |
| 1,066,581 | A | 7/1913 | Brown |
| 2,715,367 | A | 8/1955 | Kodet et al. |
| 2,748,714 | A | 6/1956 | Henry |
| 3,160,108 | A | 12/1964 | Sence |
| 3,563,618 | A | 2/1971 | Ivanov |
| 3,614,259 | A | 10/1971 | Neff |

(Continued)

FOREIGN PATENT DOCUMENTS

EP 1508361 A 2/2005

(Continued)

OTHER PUBLICATIONS

Ei-Sayed E et al.: "Performance evaluation of two RO membrane configurations in a MSF/RO hybrid system". Desalination, Elsevier, Amsterdam, NL, vol. 128, No. 3, May 1, 2000, pp. 231-245, XP004204830; ISSN: 0011-9164; p. 232-p. 234; figure 1.

(Continued)

*Primary Examiner* — Edward Look
*Assistant Examiner* — Dwayne J White
(74) *Attorney, Agent, or Firm* — Harness, Dickey & Pierce, P.L.C.

(57) ABSTRACT

A centrifugal pump includes a casing having an impeller chamber, an inlet, an outlet, and a bearing chamber. A shaft disposed within the casing has an impeller end and a motor end. The impeller is coupled to the impeller end of the shaft and is disposed within the impeller chamber. A bearing is disposed within the bearing portion. The bearing has an inboard end with an inboard-bearing surface and an outboard end with an outboard-bearing surface. The bearing and the shaft have a bearing clearance therebetween. A disc is coupled to the shaft on the impeller end which is spaced apart from the inboard-bearing surface. A seal ring is disposed between the disc and the inboard-bearing surface. The shaft, the seal ring, the disc, and the inboard-bearing surface define a thrust chamber therebetween. The thrust chamber is in fluid communication with the impeller chamber through the bearing clearance so that an axial thrust in an inboard direction is generated by the thrust chamber.

35 Claims, 3 Drawing Sheets

U.S. PATENT DOCUMENTS

| | | | | |
|---|---|---|---|---|
| 3,664,758 | A | | 5/1972 | Sato |
| 3,748,057 | A | | 7/1973 | Eskeli |
| 3,828,610 | A | * | 8/1974 | Swearingen ..... 73/862.49 |
| 3,969,804 | A | | 7/1976 | MacInnes et al. |
| 3,999,377 | A | | 12/1976 | Oklejas et al. |
| 4,028,885 | A | | 6/1977 | Ganley et al. |
| 4,029,431 | A | | 6/1977 | Bachl |
| 4,187,173 | A | | 2/1980 | Keefer |
| 4,230,564 | A | | 10/1980 | Keefer |
| 4,243,523 | A | | 1/1981 | Pelmulder |
| 4,255,081 | A | | 3/1981 | Oklejas et al. |
| 4,288,326 | A | | 9/1981 | Keefer |
| 4,353,874 | A | | 10/1982 | Keller et al. |
| 4,432,876 | A | | 2/1984 | Keefer |
| 4,434,056 | A | | 2/1984 | Keefer |
| 4,472,107 | A | | 9/1984 | Chang et al. |
| RE32,144 | E | | 5/1986 | Keefer |
| 4,632,756 | A | | 12/1986 | Coplan et al. |
| 4,702,842 | A | | 10/1987 | Lapierre |
| 4,830,572 | A | | 5/1989 | Oklejas, Jr. et al. |
| 4,966,708 | A | | 10/1990 | Oklejas et al. |
| 4,973,408 | A | | 11/1990 | Keefer |
| 4,983,305 | A | | 1/1991 | Oklejas et al. |
| 4,997,357 | A | | 3/1991 | Eirich et al. |
| 5,020,969 | A | | 6/1991 | Mase et al. |
| 5,049,045 | A | | 9/1991 | Oklejas et al. |
| 5,082,428 | A | | 1/1992 | Oklejas et al. |
| 5,106,262 | A | | 4/1992 | Oklejas et al. |
| 5,132,090 | A | | 7/1992 | Volland |
| 5,133,639 | A | | 7/1992 | Gay et al. |
| 5,154,572 | A | | 10/1992 | Toyoshima et al. |
| 5,320,755 | A | | 6/1994 | Hagqvist et al. |
| 5,338,151 | A | | 8/1994 | Kemmner et al. |
| 5,340,286 | A | | 8/1994 | Kanigowski |
| 5,482,441 | A | | 1/1996 | Permar |
| 5,499,900 | A | | 3/1996 | Khmara et al. |
| 5,702,229 | A | | 12/1997 | Moss et al. |
| 5,819,524 | A | | 10/1998 | Bosley et al. |
| 5,951,169 | A | | 9/1999 | Oklejas et al. |
| 5,980,114 | A | | 11/1999 | Oklejas, Jr. |
| 6,007,723 | A | | 12/1999 | Ikada et al. |
| 6,017,200 | A | | 1/2000 | Childs et al. |
| 6,036,435 | A | | 3/2000 | Oklejas |
| 6,110,375 | A | | 8/2000 | Bacchus et al. |
| 6,116,851 | A | | 9/2000 | Oklejas, Jr. |
| 6,120,689 | A | | 9/2000 | Tonelli et al. |
| 6,139,740 | A | | 10/2000 | Oklejas |
| 6,187,200 | B1 | | 2/2001 | Yamamura et al. |
| 6,190,556 | B1 | | 2/2001 | Uhlinger |
| 6,309,174 | B1 | | 10/2001 | Oklejas, Jr. et al. |
| 6,345,961 | B1 | | 2/2002 | Oklejas, Jr. |
| 6,468,431 | B1 | | 10/2002 | Oklelas, Jr. |
| 6,589,423 | B1 | | 7/2003 | Chancellor |
| 6,713,028 | B1 | | 3/2004 | Oklejas, Jr. |
| 6,797,173 | B1 | | 9/2004 | Oklejas, Jr. |
| 6,881,336 | B2 | | 4/2005 | Johnson |
| 6,932,907 | B2 | | 8/2005 | Haq et al. |
| 7,077,962 | B2 | | 7/2006 | Pipes |
| 7,150,830 | B1 | | 12/2006 | Katsube et al. |
| 2003/0080058 | A1 | | 5/2003 | Kimura et al. |
| 2004/0211729 | A1 | | 10/2004 | Sunkara et al. |
| 2006/0157409 | A1 | | 7/2006 | Hassan |
| 2006/0157410 | A1 | | 7/2006 | Hassan |
| 2006/0226077 | A1 | | 10/2006 | Stark |
| 2007/0056907 | A1 | | 3/2007 | Gordon |
| 2007/0199878 | A1 | | 8/2007 | Eisberg et al. |
| 2007/0289904 | A1 | | 12/2007 | Oklejas |
| 2007/0295650 | A1 | | 12/2007 | Yoneda et al. |

FOREIGN PATENT DOCUMENTS

| | | | |
|---|---|---|---|
| GB | 2363741 | A | 1/2002 |
| WO | WO02/09855 | A | 2/2002 |
| WO | WO2006/106158 | A | 10/2006 |
| WO | WO2007/146321 | A | 12/2007 |

OTHER PUBLICATIONS

Geisler P. et al.: "Reduction of the energy demand for seawater RO with the pressure exchange system PES". Desalination, Elsevier, Amsterdam, NL, vol. 135, No. 1-3, Apr. 20, 2001, pp. 205-210, XP004249642; ISSN: 0011-9164; the whole document.

* cited by examiner

THRUST BALANCING IN A CENTRIFUGAL PUMP

CROSS-REFERENCE TO RELATED APPLICATIONS

This application claims the benefit of U.S. Provisional Application No. 60/813,763, filed on Jun. 14, 2006. The disclosure of the above application is incorporated herein by reference.

TECHNICAL FIELD

The present disclosure relates generally to pumps, and, more specifically, to axial thrust compensation within a centrifugal pump.

BACKGROUND

The statements in this section merely provide background information related to the present disclosure and may not constitute prior art.

Centrifugal pumps are used for many applications including pumping water through reverse osmosis systems. In FIG. 1, a single-stage centrifugal pump 10 is illustrated. The pump 10 includes a casing 12 that includes an inlet 14, impeller chamber 16, and an outlet 18. The casing also includes a bearing portion 20.

The pump 10 has a shaft 22 that is supported within the casing 12 by bearings 24. The bearings 24 provide radial location of shaft 22. The bearings are located within the bearing portion 20.

The shaft 22 is coupled to an impeller 26. As the shaft rotates, the impeller spins generating the pumping action. The shaft 22 is coupled to a motor 28 that is used to rotate the shaft 22. A coupling 30 is used to couple the motor 28 to the shaft 22.

The impeller 26 is coupled to the impeller end of the shaft 20 while the bearings are located at the motor end of the shaft 22. The impeller end may also be referred to as the outboard direction while the motor end of the shaft is referred to as the inboard direction.

Located radially outward from the shaft 22 and the impeller 26, a volute volume 32 is formed within the impeller chamber 16. The volute volume 32 surrounds the peripheral of the impeller 26. The impeller chamber 16 also includes an outboard impeller side chamber 34 and an inboard impeller side chamber 36.

The impeller 26 may also include an impeller wear ring 40 that extends axially from the impeller toward the inlet and is concentric with the shaft 22. The casing 12 may include a casing ring 42 disposed directly adjacent to the impeller wear ring. A close clearance passage with the impeller ring 40 is formed by the casing ring 42. Fluid flows into the device in the direction illustrated by arrow 44. Fluid flows out from the pump 10 through the outlet 18 and through a diffuser 46 in the direction of arrow 48. As the pump spins, a net force indicated by arrow 50 is provided.

A shaft seal 52 isolates the impeller chamber 16 from the bearing portion 20. Thus, fluid within the impeller chamber 16 does not enter the bearing portion 20.

The motor 28 causes the pump shaft 22 to rotate the vanes 56 of the impeller 26 rotate and engage the entrained fluid causing a tangential velocity for rotation of the fluid. The rotation of the fluid imparts a radial flow causing the fluid to flow into the impeller 26 through the inlet 14 in the direction of arrow 44. Fluid exits the impeller 26 with a combined radial and tangential velocity component. The volute volume 32 accepts and directs the flow to the diffuser 46. The diffuser 46 reduces the fluid velocity and recovers a portion of the dynamic pressure in the form of static pressure. The fluid exits the diffuser 46 through the outlet 18.

In addition to radial loads on the shaft created by the weight of the impeller and the shaft, a very large force can act on the shaft in the axial direction. The axial force may be derived from two sources. The first source is the high pressure at the inlet 14 that can push the impeller 26 and the shaft 22 toward motor 28. The second source of axial force is present during the rotation of the impeller 26. The rotation of the impeller may generate a pressure at the outboard impeller side chamber 34 and the inboard impeller side chamber 36. Typically, less pressure is developed at the outboard impeller side chamber when compared to the inboard impeller side chamber due to the wear ring 40. A pressure inboard on the impeller 26 may result in the net force illustrated by arrow 50 in the outward or outboard direction. The axial force induced by the impeller rotation is typically much greater than the force generated by the pressure into the inlet 14 illustrated by arrow 44, thus a net axial force indicated by arrow 50 may result.

The bearing 24 may be various types of bearings including a roller contact-type bearing, such as ball bearings using oil or grease lubrication. When bearings 24 using oil or grease lubrication are present, a shaft seal 52 isolates the pressurized fluid in the impeller chamber 16 from the bearing 24. The bearings 24 also accommodate both axial thrust and radial thrust forces.

SUMMARY

The present disclosure provides a method in structure for generating axial thrusts in the outboard direction.

In one aspect of the disclosure, a centrifugal pump includes a casing having an impeller chamber, an inlet, an outlet, and a bearing chamber. A shaft disposed within the casing has an impeller end and a motor end. The impeller is coupled to the impeller end of the shaft and is disposed within the impeller chamber. A bearing is disposed within the bearing portion. The bearing has an inboard end with an inboard-bearing surface and an outboard end with an outboard-bearing surface. The bearing and the shaft have a bearing clearance therebetween. A disc is coupled to the shaft on the impeller end which is spaced apart from the inboard-bearing surface. A seal ring is disposed between the disc and the inboard-bearing surface. The shaft, the seal ring, the disc, and the inboard-bearing surface define a thrust chamber therebetween. The thrust chamber is in fluid communication with the impeller chamber through the bearing clearance so that an axial thrust in an inboard direction is generated by the thrust chamber.

The centrifugal pump may be used in various types of systems including a reverse osmosis system.

A method of operating a centrifugal pump having a casing with an impeller chamber, an inlet, an outlet, and a bearing chamber is set forth. The centrifugal pump includes a shaft having an impeller and a motor end. The impeller is coupled to the impeller end of the shaft and is disposed within the impeller chamber. A bearing is disposed within the bearing portion. The bearing has an inboard end having an inboard-bearing surface and an outboard end having an outboard-bearing surface. The method includes rotating the impeller and generating an outboard axial force on the shaft, communicating fluid from the impeller chamber through a bearing clearance between the bearing and the shaft to a thrust chamber at the inboard end of the bearing and generating an inboard axial force in response to communicating fluid.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
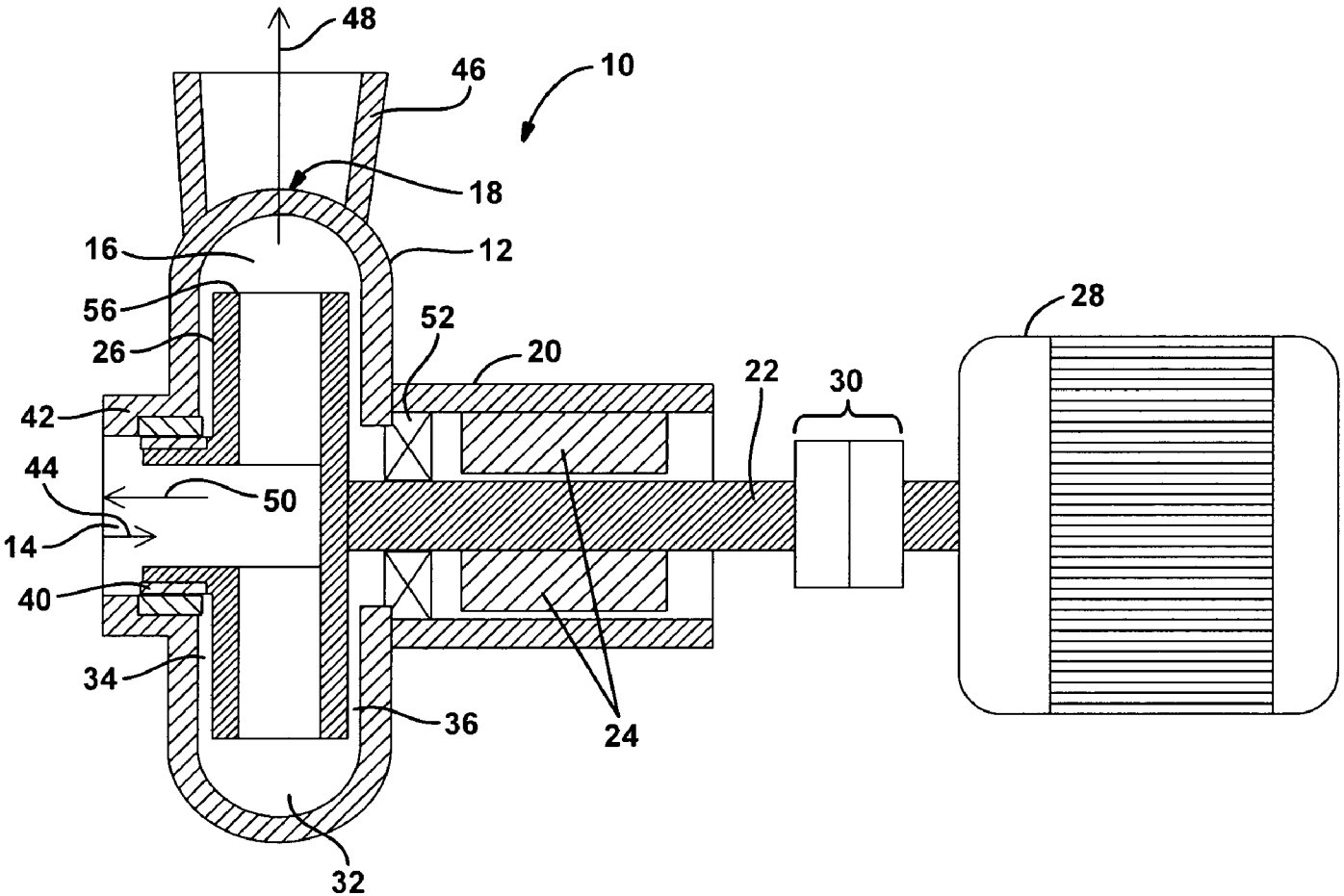
FIG. 1 Prior Art
FIG. 1 is a cross-sectional view of a centrifugal pump according to the prior art.

The following description is merely exemplary in nature and is not intended to limit the present disclosure, application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

Figure 2:
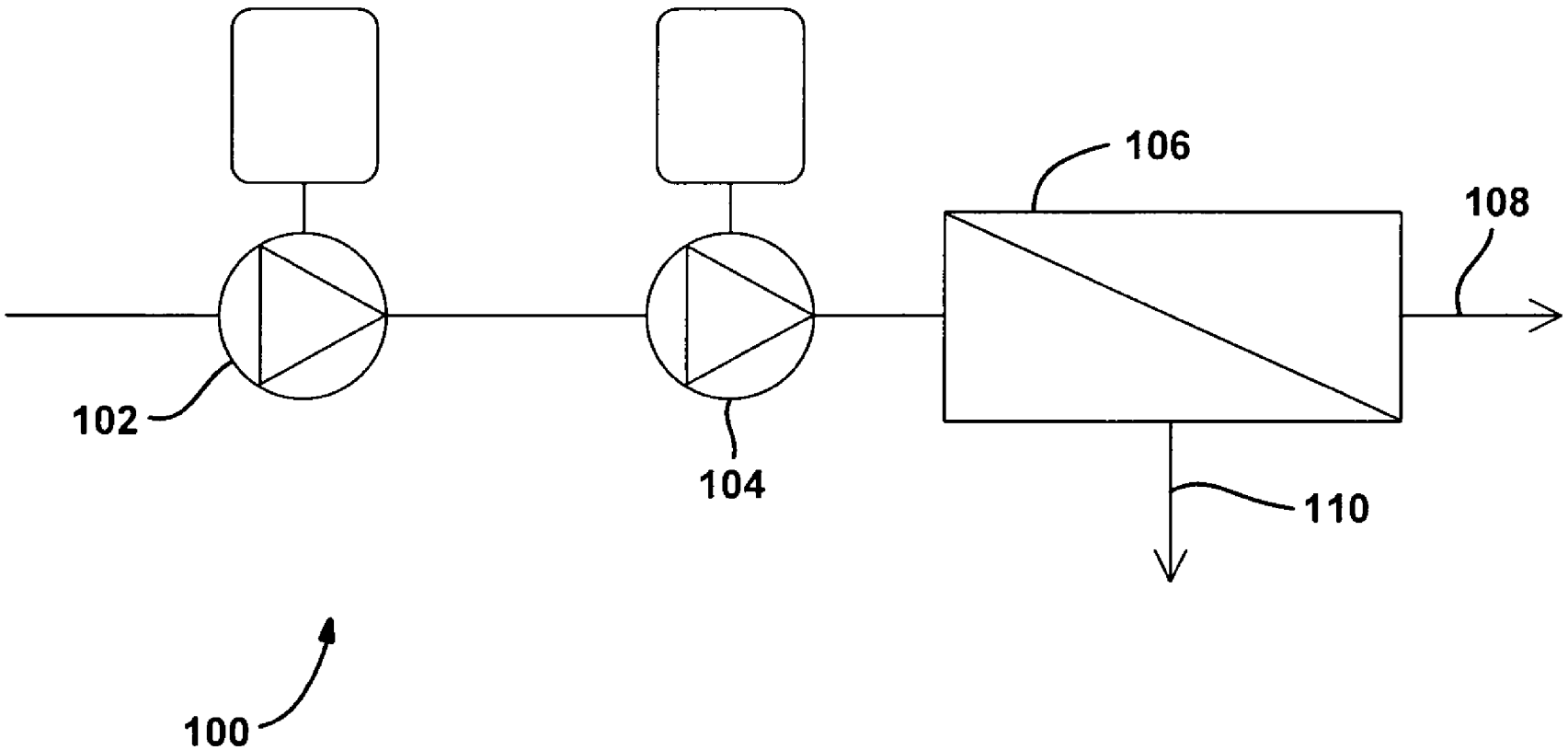
FIG. 2 is a schematic view of a centrifugal pump used in a reverse osmosis system.

Referring now to FIG. 2, a reverse osmosis system that includes a pump 102 is illustrated. A second pump 104 may also be included in the system. The pumps 102 and 104 may be centrifugal pumps formed according to the present disclosure. The pumps 102 and 104 provide highly pressurized fluid to a reverse osmosis membrane 106. Low pressure permeate fluid exits the reverse osmosis membrane 106. High pressure brine 110 also exits from the reverse osmosis membrane 106. The centrifugal pump, according to the present disclosure, may be used to highly pressurize the fluid within pump 102 or may be used as a supplemental pump 104. The supplemental pump 104 may be used to adjust for variances in the operation of the system. The supplemental pump 104 may generate lower pressures than pump 102. Suitable uses for the pumps are described in the publication entitled "Water Desalinization Installation," Serial No. PCT/EP2003/005390, the disclosure of which is incorporated by reference herein.

The present disclosure uses a fluid-lubricated sleeve-bearing 200 in place of the bearing 24 described above. Many of the same elements are identical and, thus, are labeled the same as FIG. 1 above. In addition to the fluid-lubricated sleeve bearing 200, a disc 202 fixedly mounted to the inboard side of the shaft 22 is illustrated. The disc 202 is spaced apart from an inboard-bearing surface 204 on the axial end of the bearing 200.

A seal ring 206 is disposed between the disc 202 and the inboard-bearing surface 204. In this embodiment, the seal ring 206 is disposed upon the disc 202. However, the seal ring 206 may also be disposed on the inboard-bearing surface 204.

The shaft 22, the disc 202, the inboard-bearing surface 204, and the seal ring 206 define a thrust chamber 208.

The diameter of the seal ring 206 may be about the same size as the diameter of impeller ring 40. However, various sizes of seal rings may be used, depending on the forces involved and other designed specific parameters.

The shaft 22 and the bearing 200 have a bearing clearance 210 therebetween. The bearing clearance 210 allows fluid between the shaft 22 and the bearing 200.

A thrust disc 216 may be disposed on the shaft 22. The thrust disc 216 has a diameter to allow fluid to pass between the thrust disc 216 and the casing 12. Grooves 240 described in detail in FIG. 4 allow fluid to pass radially along the thrust disc. Fluid from the impeller chamber 16 enters passage 218 and travels between the thrust disc and the bearing 200. Some of the fluid travels through the bearing clearance 210 and provides fluid to the thrust chamber 218.

As mentioned above, axial thrust in the outboard direction during rotation of the impeller 26 causes the shaft 22 to move toward the inlet 14. The resulting axial motion reduces the clearance between inboard bearing surface 204 and the seal ring 206. Pressure in the thrust chamber 208 will thus increase since fluid in the relatively high pressure impeller chamber 16 will travel through the passage 218, through the bearing clearance 210, and into the thrust chamber 208. The pressure in the thrust chamber 208 causes the disc 202 to move in the inboard direction which is opposite to the axial thrust caused by the rotation of the impeller 26. Thus, the thrust force may be neutralized. The thrust force is balanced when an excessively strong counter-force is generated, the space between the seal ring 206 and the inboard bearing surface 204 increases allowing fluid to drain from the thrust chamber 208.

Figure 4:
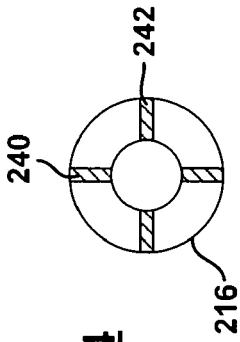
FIG. 4 is a side view of a thrust disc used in FIG. 3.

Referring now also to FIG. 4, during the initial rotation of the shaft and thus the impeller 26, axial forces may be developed in the inboard direction toward the motor 28. Thrust disc 216 may also include radial grooves 240 and 242 in the inboard surface of the thrust disc 216. During times of reverse thrust during start-up, the thrust disc 216 may rub against the outboard-bearing surface until a normal thrust direction is established. The grooves 240 and 242 permit fluid to reach the bearing clearance 210 and help lubricate the space between the outboard side of the bearing 200 and the thrust disc 216.

Figure 3:
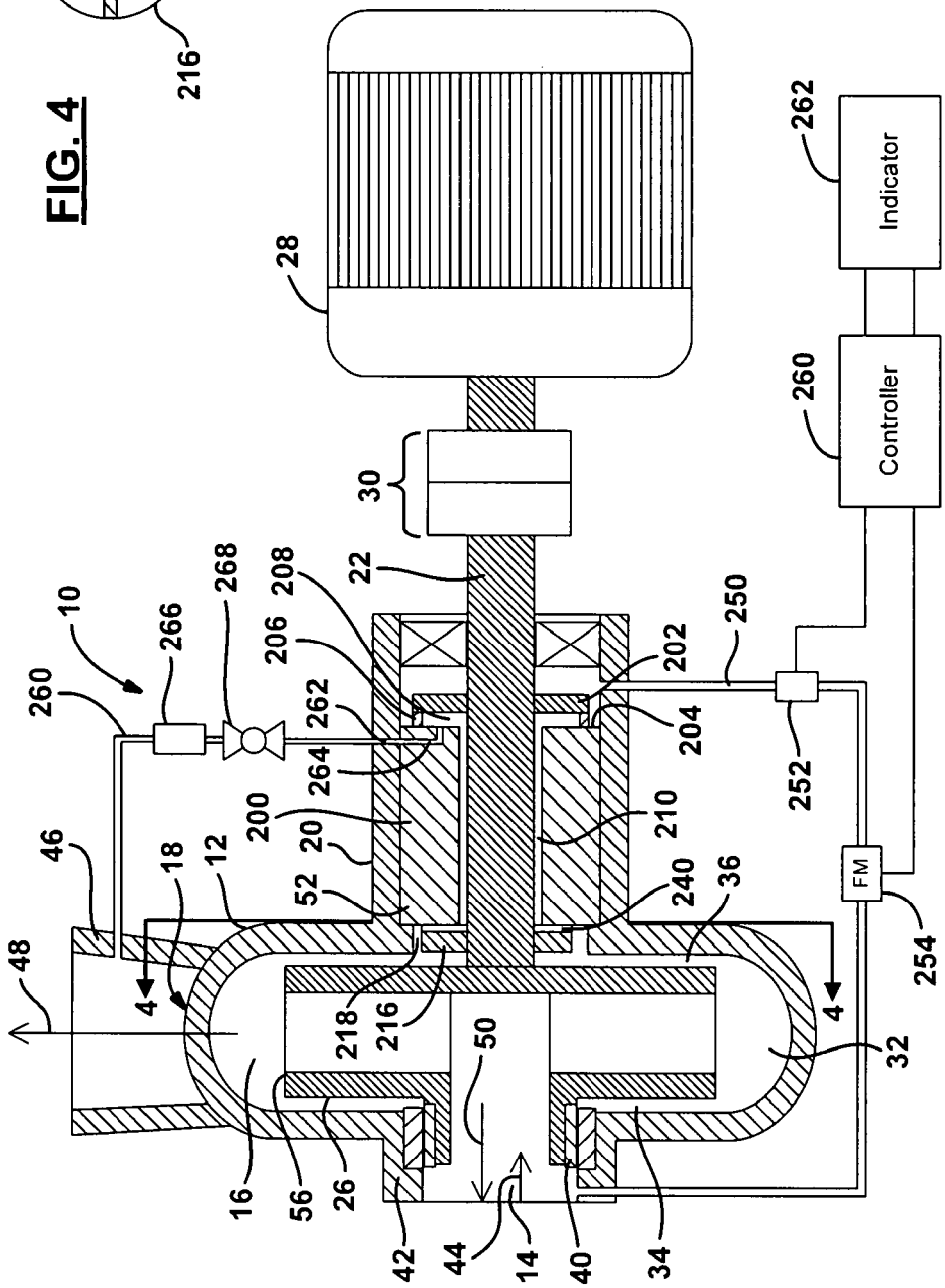
FIG. 3 is a cross-sectional view of an improved centrifugal pump according to the present disclosure.

Referring again to FIG. 3, the bearing portion may also be in fluid communication with the inlet 14 through a return pipe 250. The return pipe 250 returns leakage from the gap between the seal ring 206 and the inboard-bearing surface 204. A temperature sensor 252 may generate a temperature signal that is coupled to a controller 260. The controller 260 may be used to generate an indicator 262, such as an audible warning or a screen display visual indicator indicative of the temperature. The temperature may be indicative of excessive friction at the seal ring 206. Thus, the indicator may correspond to an excessive seal ring temperature.

A flow meter 254 may also be disposed within the return pipe 250. The flow meter 254 generates a flow signal that corresponds to the flow through the return pipe 250. The flow meter 254 can monitor the leakage rate and help monitor the condition of the seal ring 206 and the bearing clearance 210. The flow signal from the flow meter 254 may be provided to a controller 260 that generates an indicator 262 corresponding to the flow of the fluid. The return pipe 250, the temperature sensor 252, and the flow meter 254 may or may not be used in a constructive embodiment.

In a further embodiment of the disclosure, the outlet 18 may be in fluid communication with the thrust chamber 208. An inlet pipe 260 may be used to fluidically couple the outlet 18 such as at the diffuser 46 to a passage 262 in the casing 12. The passage 262 may be in fluid communication with a passage 262 in the bearing 200. The passages 262 and 264, together with the return pipe 250, allow high-pressure fluid from the outlet 18 to pass into the thrust chamber 208. A filter 266 may also be provided to prevent particulates from entering the thrust chamber 208. A valve 268 may also be provided within the input pipe 260 so that flow may be controlled to allow the pressure within the thrust chamber 208 to be regulated. Because of pressure at the outlet 18 is higher than in the bearing portion 20, fluid flows through the input pipe 260 into the thrust chamber 208.

In operation, when the impeller 26 first starts to rotate under the power of the motor 28, initial thrust may move the shaft in the inboard direction. The thrust disc 216 and grooves 240 and 242 may be used to lubricate the outboard axial end of the bearing 200. After the initial start-up and rotation of the impeller 26, the rotating impeller 26 generates an outboard axial force on the shaft. Fluid is communicated from the impeller chamber 16 and, more specifically, the inboard impeller side chamber through the passages 218, grooves 240 and 242 into the bearing clearance 210. Fluid thus travels into the thrust chamber 208 to provide a counter-acting force on the disc 202 and, thus, the shaft 22.

To help regulate the flow into the thrust chamber 208, fluid from the input pipe 260 may travel through the casing and the bearing to provide fluid into the thrust chamber 208.

To remove fluid from the bearing portion 20, the return pipe 250 may be used to return fluid to the inlet portion 14. The temperature and/or flow or both of the fluid may be monitored by a controller 260 and generate an indicator indicative of where of the sealing ring or the bearing clearance or both.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A centrifugal pump comprising:

a casing having an impeller chamber, an inlet, an outlet and a bearing chamber;

a shaft having an impeller end and a motor end;

an impeller coupled to the impeller end of the shaft disposed within the impeller chamber;

a bearing disposed within the bearing chamber, said bearing having an inboard end having an inboard bearing surface and an outboard end having an outboard bearing surface;

said bearing and said shaft having a bearing clearance therebetween;

a disc coupled to the impeller end of the shaft spaced apart from the inboard bearing surface; and a seal ring disposed between the disc and the inboard bearing surface;

said shaft, said seal ring, said disc and said inboard bearing surface defining a thrust chamber therebetween;

said thrust chamber in fluid communication with the impeller chamber through the bearing clearance so that an axial thrust in an inboard direction is generated.

2. A centrifugal pump as recited in claim 1 further comprising a motor coupled to the shaft.

3. A centrifugal pump as recited in claim 1 wherein the inlet comprises an inlet coaxial with the shaft.

4. A centrifugal pump as recited in claim 1 wherein the seal ring is directly coupled to the disc.

5. A centrifugal pump as recited in claim 1 further comprising an impeller ring disposed on the impeller, said impeller ring having a first diameter and wherein said seal ring is about the first diameter.

6. A centrifugal pump as recited in claim 1 further comprising a thrust disc attached to the shaft between the impeller and the bearing.

7. A centrifugal pump as recited in claim 6 wherein the thrust disc has a radial channel therein so that fluid from the impeller chamber is communicated through the bearing clearance.

8. A pumping system comprising the centrifugal pump recited in claim 1.

9. A pumping system as recited in claim 8 wherein the pumping system comprises a reverse osmosis pumping system.

10. A pumping system as recited in claim 8 further comprising a return pipe fluidically coupling the bearing chamber to the inlet.

11. A pumping system as recited in claim 8 further comprising a temperature sensor generating a temperature signal corresponding to a temperature within the return pipe.

12. A pumping system as recited in claim 11 further comprising a controller generating an indicator in response to the temperature signal.

13. A pumping system as recited in claim 12 wherein the indicator comprises an excessive friction indicator.

14. A pumping system as recited in claim 8 further comprising a flow meter generating a flow signal corresponding to a fluid flow temperature within the return pipe.

15. A pumping system as recited in claim 14 further comprising a controller generating an indicator in response to the flow signal.

16. A pumping system as recited in claim 15 wherein the indicator comprises a leakage indicator.

17. A pumping system as recited in claim 8 further comprising an input pipe fluidically coupling the outlet to the thrust chamber.

18. A pumping system as recited in claim 17 further comprising a filter disposed within the input pipe.

19. A pumping system as recited in claim 17 further comprising a valve in the input pipe for regulating a flow through the input pipe.

20. A method of operating a centrifugal pump having a casing with an impeller chamber, an inlet, an outlet and a bearing chamber, a shaft having an impeller end and a motor end, an impeller coupled to the impeller end of the shaft disposed within the impeller chamber, a bearing disposed within the bearing chamber, said bearing having an inboard end having an inboard bearing surface and an outboard end having an outboard bearing surface, comprising:

rotating the impeller and generating an outboard axial force on the shaft;

communicating fluid from the impeller chamber through a bearing clearance between the bearing and the shaft to a thrust chamber at the inboard end of the bearing; and generating an inboard axial force in response to communicating fluid.

21. A method as recited in claim 20 wherein the thrust chamber is defined by said shaft, said seal ring, a disc coupled the shaft and said inboard bearing surface.

22. A method as recited in claim 20 further comprising providing fluid into the impeller chamber in a direction coaxial with the shaft.

23. A method as recited in claim 20 further comprising fixedly coupling the seal ring to the disc.

24. A method as recited in claim 20 further comprising coupling a thrust disc attached to shaft between the impeller and the bearing.

25. A method as recited in claim 24 further comprising communicating fluid through a radial channel of the thrust disc to the bearing clearance.

26. A method as recited in claim 20 further comprising fluidically coupling the bearing chamber to the inlet with a return pipe.

27. A method as recited in claim 26 further comprising monitoring a temperature within the return pipe.

28. A method as recited in claim 27 further comprising generating an indicator in response to the temperature signal.

29. A method as recited in claim 28 wherein the indicator comprises an excessive friction indicator.

30. A method as recited in claim 26 further comprising monitoring a flow within the return pipe.

31. A method as recited in claim 30 further comprising generating an indicator in response to the flow.

32. A method as recited in claim 31 wherein the indicator comprises a leakage indicator.

33. A method as recited in claim 20 further comprising fluidically coupling the outlet to the thrust chamber with an input pipe.

34. A method as recited in claim 33 further comprising filtering within the input pipe.

35. A method as recited in claim 33 further comprising regulating a flow through the input pipe.

* * * * *